United States Patent [19]

Svirklys

[11] 3,971,326

[45] July 27, 1976

[54] PALLET CONSTRUCTION

[75] Inventor: Ferdinand M. Svirklys, Toronto, Canada

[73] Assignee: Extrados Company Limited, Toronto, Canada

[22] Filed: May 21, 1975

[21] Appl. No.: 579,410

[52] U.S. Cl. ..... 108/56.1; 52/483; 52/579; 52/588; 52/669

[51] Int. Cl.[2] ..... B65D 19/28

[58] Field of Search ..... 108/51–58; 52/474, 483, 486, 494, 621, 629, 664, 669, 735, 758 A, 758 D, 760, 579, 588

[56] References Cited

UNITED STATES PATENTS

| | | | |
|---|---|---|---|
| 3,044,586 | 7/1962 | Cassels | 52/758 A X |
| 3,294,040 | 12/1966 | Gregoire | 108/53 |
| 3,373,534 | 3/1968 | Berridge | 52/544 X |
| 3,528,391 | 9/1970 | Johnson | 52/588 X |
| 3,548,556 | 12/1970 | Vermeulen | 52/669 X |
| 3,620,027 | 11/1971 | Nordell | 52/494 X |
| 3,862,464 | 1/1975 | Arens | 52/664 X |
| 3,914,913 | 10/1975 | Roberts | 52/579 X |

FOREIGN PATENTS OR APPLICATIONS

| | | | |
|---|---|---|---|
| 648,611 | 1/1951 | United Kingdom | 108/51 |

*Primary Examiner*—Roy D. Frazier
*Assistant Examiner*—William E. Lyddane
*Attorney, Agent, or Firm*—Sim & McBurney

[57] ABSTRACT

A knock-down pallet is constructed of a plurality of releasably interlocking aluminum members of one of two types. A unique fastening device is used to achieve, in simple manner without special tools or skill, the interlocking of a plurality of spaced-parallel deck-forming members to two, three or more spaced and parallel stringer members of rectangular cross-section to provide a one-or two-deck two-way or four-way pallet construction. A stop means prevents longitudinal movement of the deck members transverse of the stringer members.

26 Claims, 11 Drawing Figures

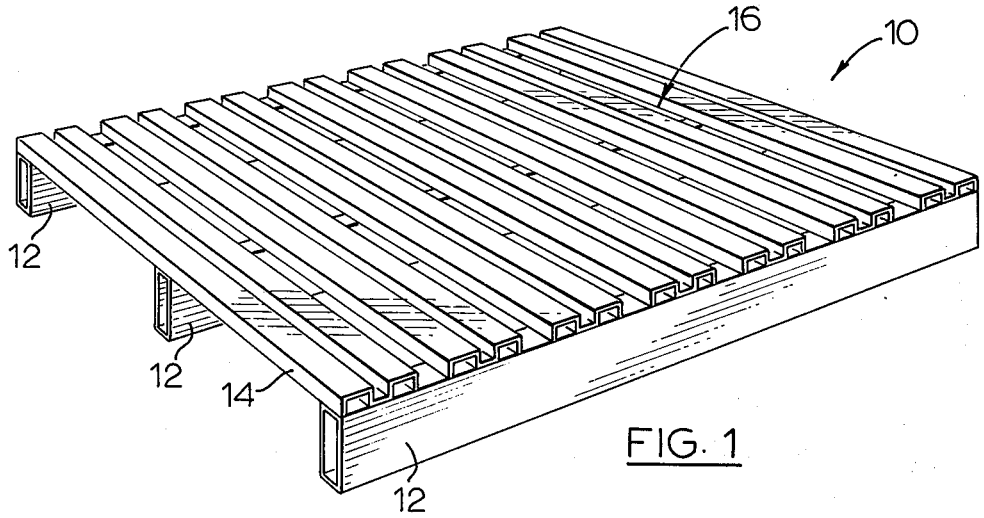
FIG. 1
FIG. 2
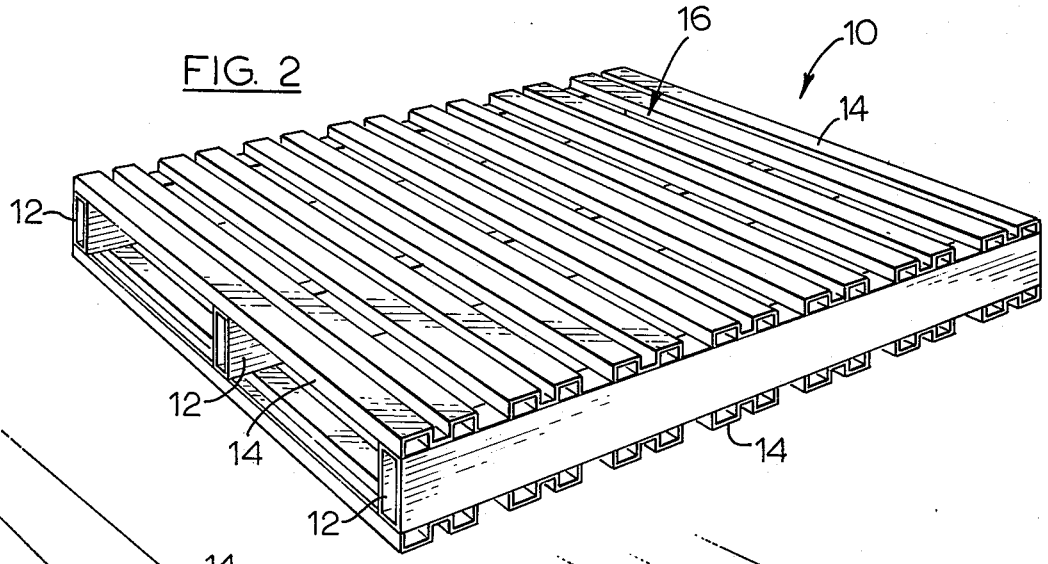
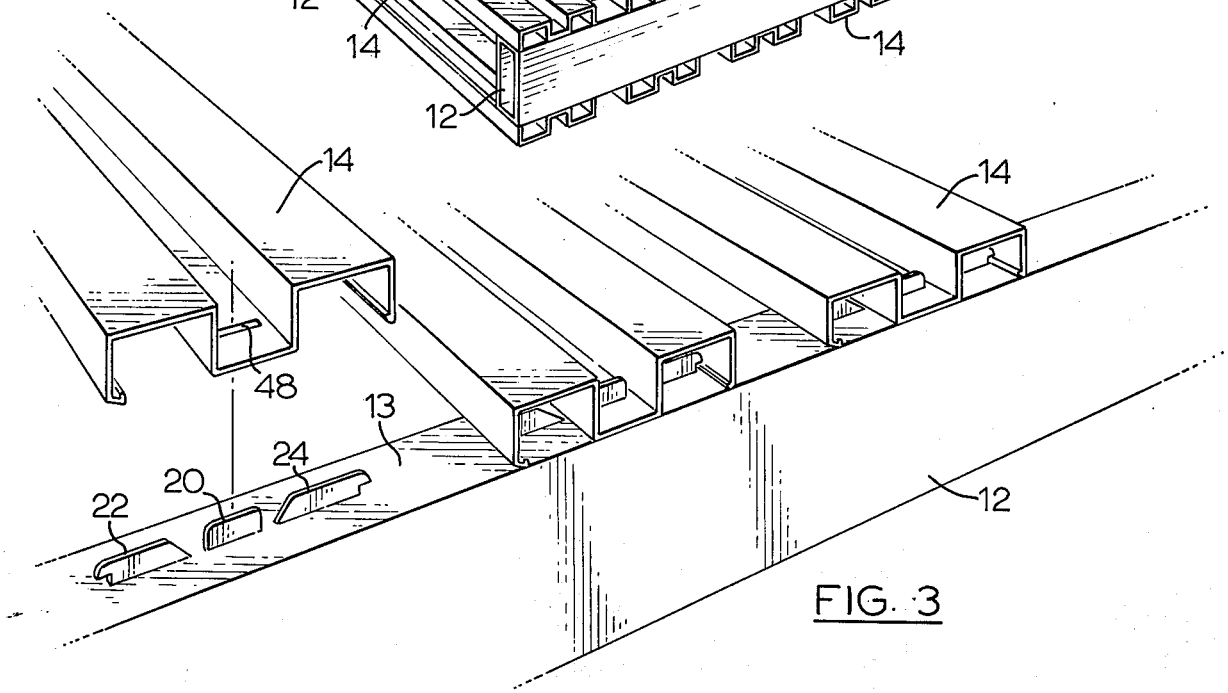
FIG. 3

PALLET CONSTRUCTION

FIELD OF INVENTION

This invention relates to pallet constructions.

BACKGROUND OF THE INVENTION

Pallets for warehousing use and material handling typically have been constructed of wood and provided in a permanent structure. Pallets generally have one or two decks and are provided in two-way entry or four-way entry types.

Wooden pallets although used almost universally in material handling suffer from considerable drawbacks. In view of the permanence of the structure, wooden pallets occupy considerable storage area during shipping from the manufacturer to the consumer and when not in use. Wooden pallets cannot be stored out-of-doors as moisture is readily absorbed, increasing its weight, altering its dimension, promoting fungal and bacterial growth, and leading to degradation of the material on prolonged exposure. The bulk size and the necessity to store wooden pallets in a sheltered area gives rise to considerable shipping and storage costs.

Further, wooden pallets typically are quite heavy and can be used only with considerably difficulty in certain industries, such as the food industry, in which cleanliness and corrosion resistance are essential. Effective sterilization of wooden pallets is extremely difficult.

Construction of pallets from wood constitutes as potential fire hazard due to the ready flammability of wood.

Damaged wooden pallets generally are not repairable and represent a considerable disposal problem. Reclamation of the wood generally is not practical or feasible due to the various nails, screws or other fasteners used in the construction and the damaged pallets have to be disposed of by burning or as land-fill. The former manner of disposal generally is impractical, due to air pollution control requirements, and the latter manner is expensive, both in terms of haulage costs to a suitable dump and space occupied at the land-fill.

Further, wooden pallets generally are not readily color-keyed for various uses, since suitable paints for this purpose either lack the strength to withstand extensive use and hence are easily removed during use of the pallets, or are so expensive as to be prohibitive.

In view of these difficulties, attempts have been made to use other construction materials for the provision of pallets, typically plastics. However, plastic pallets suffer from several drawbacks, such as, the plastic materials involved are quite expensive, the pallets must be molded as a single unit again giving rise to bulk size problem, a minor crack in the structure is sufficient to seriously impair the strength of the pallet, the pallets are severely affected by extremes of temperature, the plastic generally is degraded by exposure to sunlight, and damaged pallets are difficult to dispose of economically.

SUMMARY OF INVENTION

The present invention seeks to overcome the prior art difficulties of pallet constructions. In accordance with the present invention, a pallet is constructed wholly of aluminum in an assemblable and disassemblable form. The pallet is formed only from a plurality of one type of member and a plurality of a second type of member, the types of extrusion being interlocked by a unique locking structure. The interlocking of the two types of member to provide the pallet and the disassembly of the interlock are achievable without the necessity for any special tools or skills.

BRIEF DESCRIPTION OF DRAWINGS

FIG. 1 is a perspective view of a single deck two-way pallet construction provided in accordance with the invention;

FIG. 2 is a perspective view of a two-deck two-way pallet construction provided in accordance with the invention;

FIG. 3 is a close up view of one side of the pallet of FIG. 1, partly exploded, showing the interlocking of the pallet-forming members;

DESCRIPTION OF PREFERRED EMBODIMENTS

Figure 4:
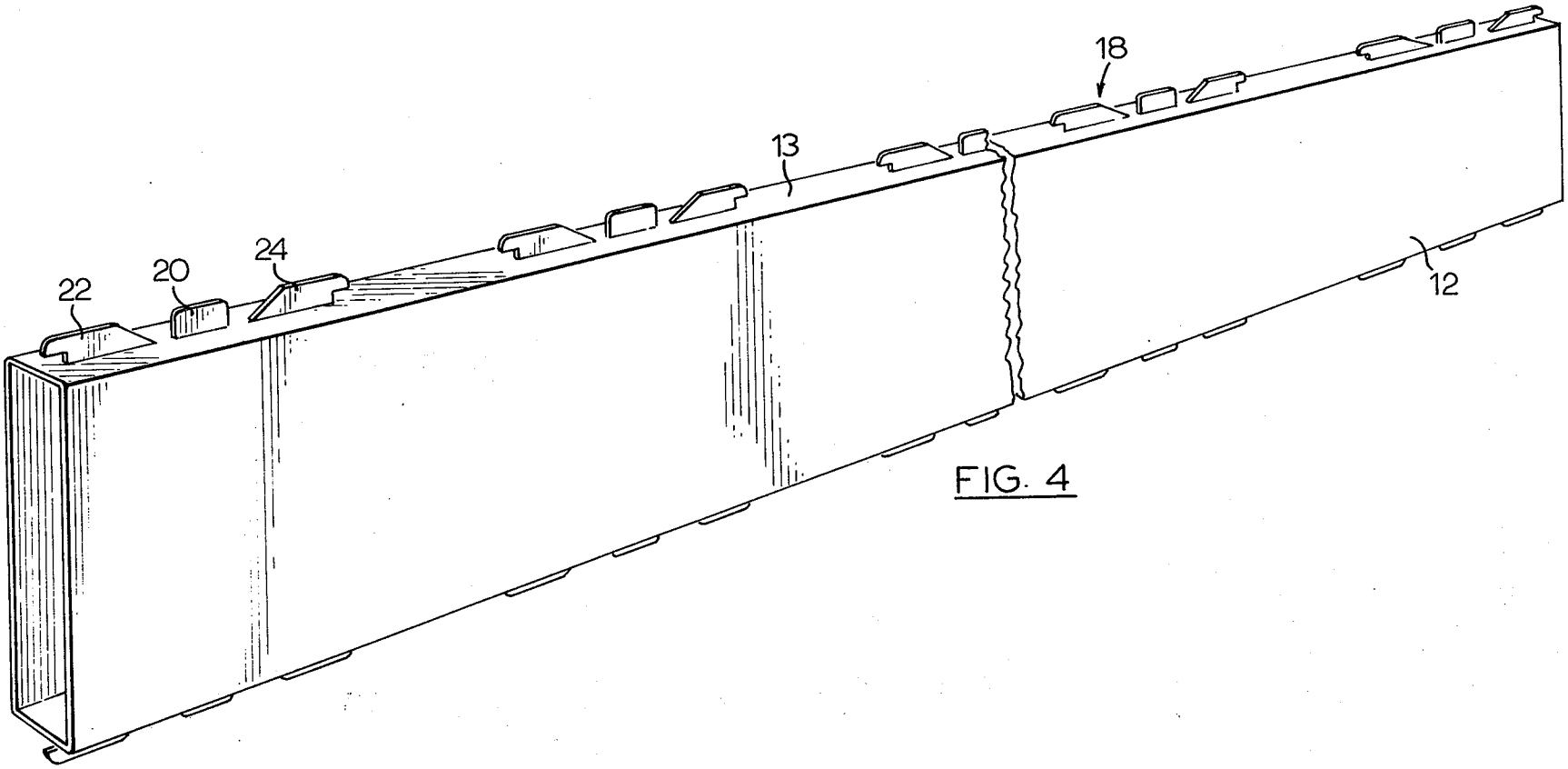
FIG. 4 is a perspective view of one element used in the pallet construction of FIG. 2.
Figure 5:
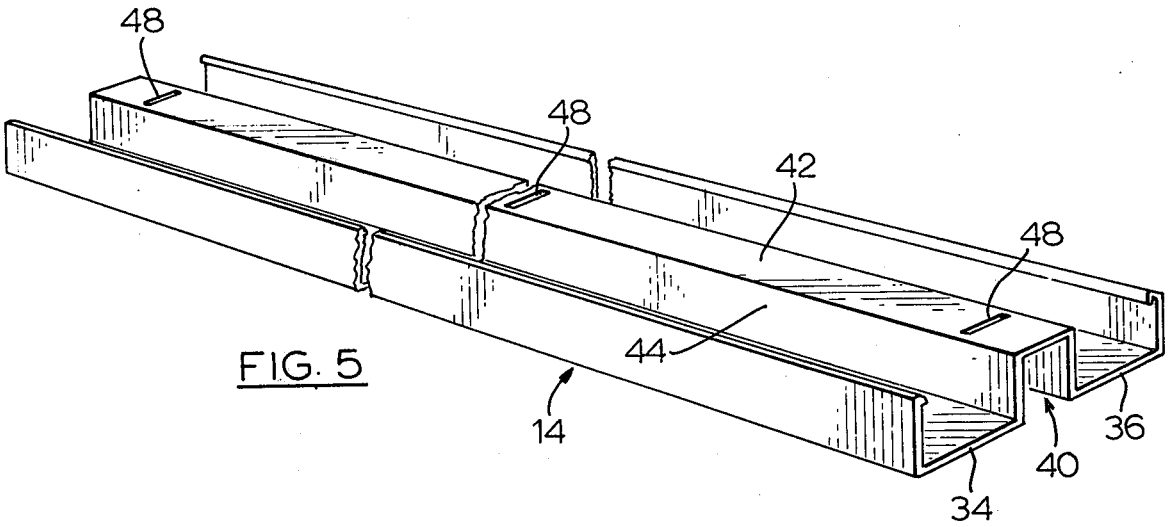
FIG. 5 is a perspective view of another element used in the pallet construction of FIG. 1 or 2.

Referring to the drawings, FIGS. 1 and 2 illustrate single-and double-deck one-way entry pallet constructions respectively which utilize basically the same units and assembly principle, with the exception of modifications required to provide a single-or double-deck construction.

A pallet 10 constructed of aluminum parts includes three hollow elongate members or stringer elements 12 of rectangular cross section and arranged with their longer dimension upright so that the outer surface 13 of the shorter dimension provides a supporting surface. The rectangularly cross-sectioned members 12 are arranged parallel to each other.

While the pallet of FIGS. 1 and 2 is illustrated as having three elongate members or stringer elements 12, this number is not essential but rather is preferred. Two or four or more such elements 12 may be used, depending on the size and strength of pallet desired.

A plurality of deck-forming elongate members 14 are supported on the outer surfaces 13 and are releasably connected to the rectangularly cross sectioned members 12 in spaced parallel relation generally perpendicular to the rectangularly cross-sectioned member 12 and cooperate to provide a deck 16 on one side only or on both sides of the pallet 10, depending on the type desired.

The deck-forming members 14 are releasably connected to the rectangularly cross-sectioned members 12 in such a manner as to prevent movement of the deck-forming members 14 longitudinally thereof and laterally to the rectangularly cross-sectioned members 12, in a manner described in more detail below, so that the structure is stable.

Each rectangularly cross-sectioned member 12 includes a plurality of sets of protrusions 18, extending either from the top outer surface 13 only, in the case of the pallet construction of FIG. 1 or from the top and bottom outer surfaces 13, in case of the pallet construction of FIG. 2. The longitudinal dimension of each set of protrusions 18 is substantially equal to the width of each deck-forming member 14.

The number of the sets of protrusions 18 is equal to the number of deck-forming members 14 to be attached to the rectangularly cross-sectioned member 12 and the number is the same for each of the rectangularly cross-sectioned members 12.

The spacing apart of the sets of protrusions 18 from each other on the surface 13 of the rectangularly cross-sectioned member 12 may vary widely, depending on the spacing desired between the deck-forming members in the pallet 10, which in turn is dependent on the desired end use and desired strength of the pallet 10.

Each of the sets of protrusions 18 includes a central member 20, a left hand member 22 and a right hand member 24. Each member of the set 18 extends upwardly generally perpendicular to the surface 13 and extends in straight line alignment with the other members of the set and with the members in other sets longitudinally of the surface 13. Each member is thin laterally.

The left and right hand member 22 and 24, which have mirror-image shapes, are undercut at their ends remote from the central member 20 to define shoulders 26 and 28 respectively and undercuts 30 and 32 respectively.

Each of the deck-forming members 14 includes first and second elongate parallel coplanar elements 34 and 36 intended to cooperate with the elements 34 and 36 of the other deck-forming members 14 to define a planar load-supporting surface.

The coplanar elements 34 and 36 are joined by an integral member defining a channel 40 therebetween and including a first elongate portion 42 situated in a plane parallel to the plane of the coplanar elements 34 and 36 and intended to engage the outer surface 13 of the rectangularly cross-sectioned element 12 and first and second upright elements 44 and 46 integrally joining the elongate portion 42 and the coplanar elements 34 and 36.

The elongate portion 42 has three slots 48 formed therethrough of length and dimension sufficient to receive the central member or tab 20 of each set of protrusions therethrough.

Three slots 48 are used corresponding to the three rectangularly cross-sectioned members 12 used to form the pallet constructions of FIGS. 1 and 2 and the central slot is spaced equally from the two ends. Where two or more than three such rectangularly cross-sectioned members 12 are used, then the corresponding number of slots 48 may be provided.

The slots 48 adjacent the ends of each member 14 are spaced inwardly a distance corresponding to the distance of the tabs 20 from the edge of the surface 13, so that, when the pallet is assembled, the ends of the deck forming members are flush with the outer surfaces of the rectangularly cross-sectioned element 12, as illustrated in FIGS. 1 and 2.

If desired, the end slots 48 may be positioned a further distance from the ends of the member 14, so that the assembled pallet has the outer rectangularly cross-sectioned elements 12 recessed with the deck or decks 16 overhanging the outer elements 12.

The deck-forming elements 14 also include integral skirt portions 50 and 52 depending from the coplanar elements 34 and 36 generally perpendicularly thereto at the sides of the deck-forming elements 14. The skirt portions 50 and 52 extend a distance substantially equal to the depth of the channel 40.

At the lower end of each skirt portion 50 and 52 is a shoulder-engaging member 54 and 56 respectively.

Each shoulder-engaging member includes a portion projecting inwardly of the skirt 50 or 52 towards the first elongate portion 42 and a shoulder-face-engaging portion. Generally shoulder-engaging member 54 projects inwardly in greater distance than shoulder-engaging member 56 and a distance substantially equal to the depth of the undercut 30.

Figure 6:
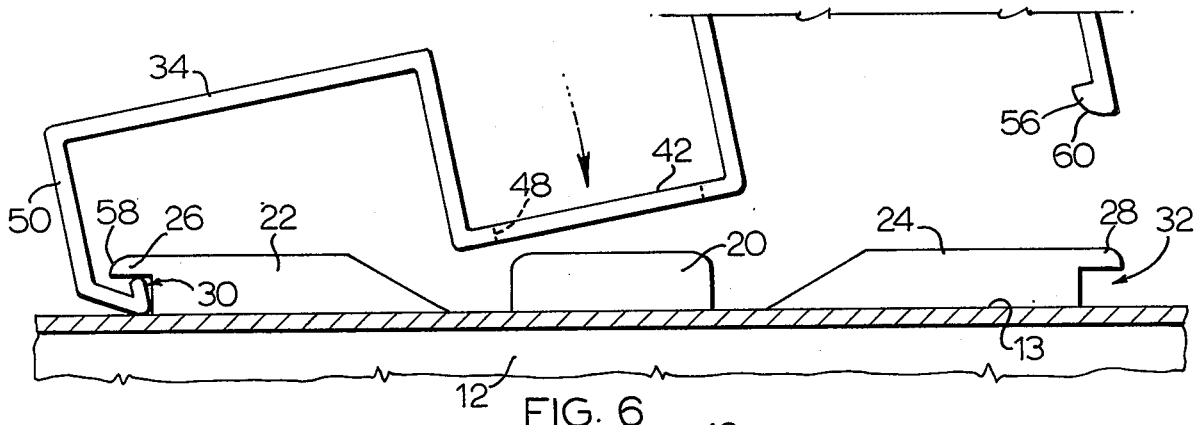
FIGS. 6 and 7 are views of the interlocking of the members to form the pallet construction of FIGS. 1 and 2.
Figure 7:
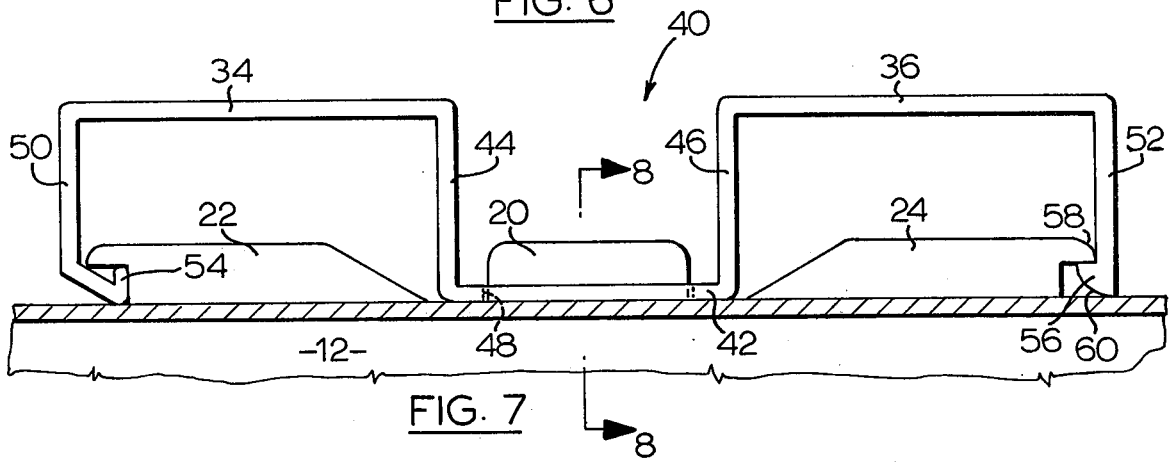
Figure 8:
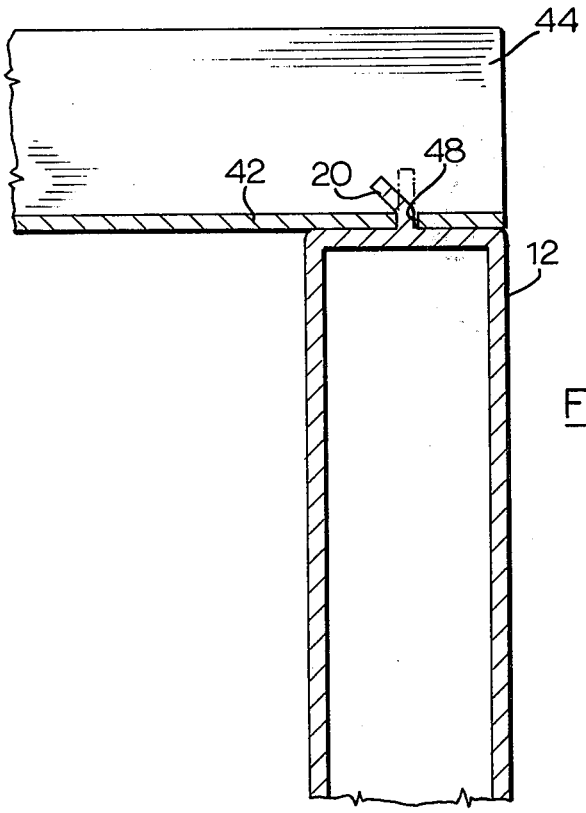
FIG. 8 is a sectional view of part of the interlock taken on line 8—8 of FIG. 7 in a permanently-locked position.

While the undercuts 30 and 32 have the same dimensions and depth approximately equal to the extremity of the shoulder-engaging member 54, this arrangement is for convenience in assembly of the pallet, allowing the longer shoulder-engaging member 54 to be inserted in either undercut to engage both the shoulder and the end wall of the undercut, so that the arrangement shown in FIGS. 6 and 7 with respect to the relative positions of shoulder-engaging members 54 and 56 and undercuts 30 and 32 may be reversed. Further, not all the extrusions 14 need to be connected to extrusions 12 by the illustrated arrangement.

However, if desired, the undercuts 30 and 32 may be dimensioned such that undercut 30 has a depth at least equal to the maximum distance of extension of the shoulder engaging member 54 and the undercut 32 has a lower depth at least equal to the maximum distance of extension of the shoulder-engaging member 54 and less than the maximum distance of extension of the shoulder-engaging member 56.

Each shoulder 26 and 28 has a sloping outer surface 58. The surface of the shoulder-engaging member 56 intended to engage the sloping surface 58 during assembly, as described below, is also curved at 60.

Each of the deck-forming members 14 has a thickness and size allowing limited flexibility when bent about its longitudinal centre line. This flexibility, the dimensioning of the deck-forming members 14 and the set of protrusions 18, the shape of the members 22 and 24 and the dimensioning of the shoulder-engaging members 54 and 56 combine to provide snap fit means, readily-releasable interlocking of the deck-forming member 14 and the rectangularly cross-sectioned extrusion 12. Further, the interlocking and releasing of the pallet-forming elements 12 and 14 is achievable without the use of special tools or skills.

As seen particularly in FIGS. 6 and 7, the pallet of FIG. 1 and 2 is assembled by, at each intersection of deck-forming member 14 and rectangularly cross-sectioned extrusion 12, inserting the longer shoulder-engaging member 54 into the undercut 30 and pushing the shorter shoulder engaging member 56 against the upper and outer surface of the shoulder 28, causing the extrusion 14 to flex slightly about its centre line, thereby moving the shoulder-engaging members 54 and 56 a greater distance apart, so that the curved surface 60 of the shoulder engaging member 86 rides on and round the surface 58 of shoulder 28 and snap-fits into the undercut 32 in engagement with the underside of the shoulder 56.

Disassembly of the interlock is readily achieved by flexing the member 14 about its center line until the shoulder-engaging members 54 and 56 are spaced apart a distance sufficient to remove the shoulder-engaging member 56 from the undercut 32.

The interaction of the central member or tab 20 in and the walls of the slot 48 constitutes stop means and prevents longitudinal movement of the member 14, so that a stable pallet construction is provided, and permits release of the members 12 and 14 for pallet disassembly.

In some instances it may be desired to provide the pallet in a permanent form, in which case the central members or tabs 20 may be twisted or bent over, as seen in the cross-section of FIG. 6, to prevent withdrawal of the tabs 20 through the slots 48.

While the three members of each set of protrusions is illustrated as being provided in a straight line, this construction is for convenience of formation of the extrusion 12. However, the members may be offset from straight line alignment, with the slots 48 being appropriately positioned.

The interlock which is used in the provision of the pallets of the invention and as illustrated above has a variety of other uses, where it is desired to interconnect two elements, one of which has limited flexibility along a line generally transverse to the other extrusion and forms another embodiment of the invention.

It will be seen from the above description of FIGS. 1 to 8 that the present invention provides a pallet construction which is in a knock-down form and which is formed from only two types of aluminum members the members of each type being completely interchangeable one with another. The pallet may be assembled without any special tools or skills.

Figure 9:
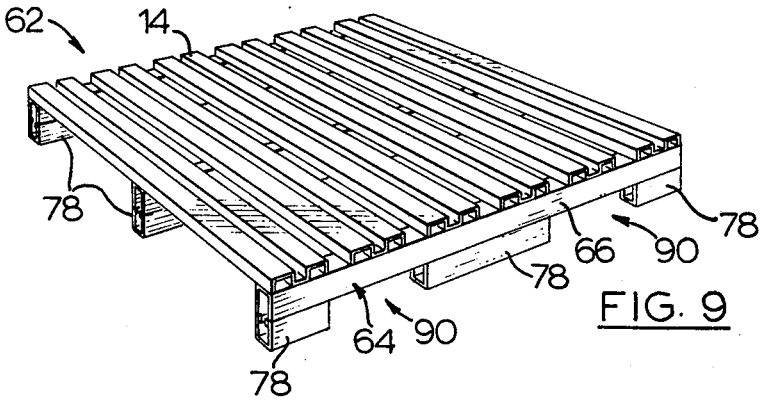
FIG. 9 is a perspective view of a one-deck four-way pallet construction provided in accordance with the invention.
Figure 10:
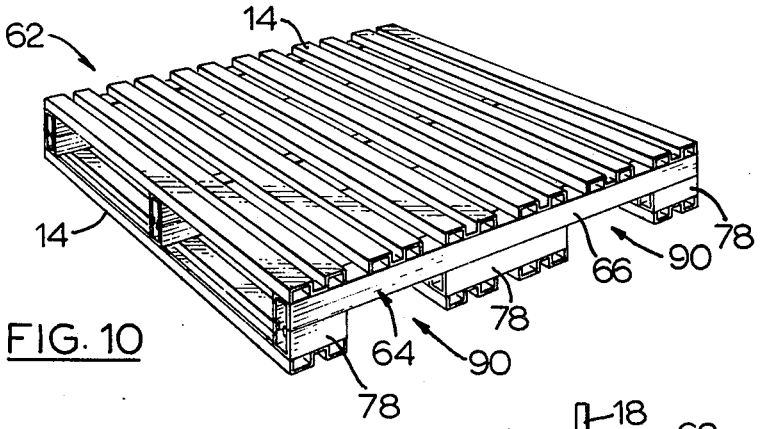
FIG. 10 is a perspective view of a two-deck four-way pallet construction provided in accordance with the invention.
Figure 11:
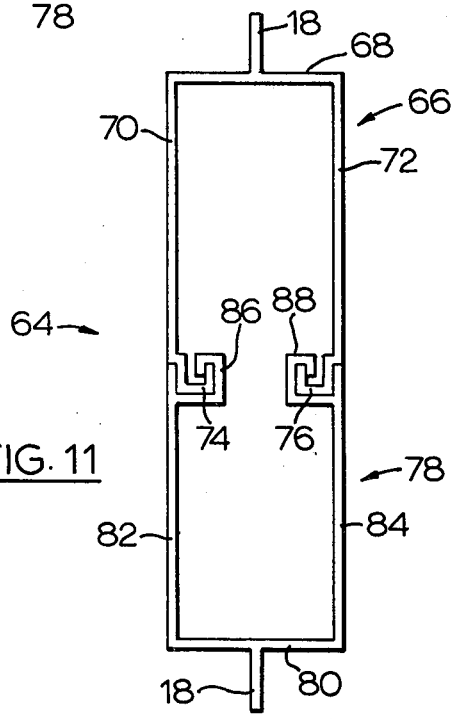
FIG. 11 is a section taken on line 11—11 of FIG. 10.

Turning now to consideration of FIGS. 9 to 11, there are shown modifications of the two-way pallet constructions of FIG. 1 and 2 to provide a four-way pallet construction.

FIGS. 9 and 10 illustrate respectively single-deck and two-deck versions of a four-way pallet 62 having the same deck-forming members 14 as the pallets of FIGS. 1 and 2 releasably connected to elongate members or stringer elements 64 using snap fit means and stop means in the same manner as described above for the releasable interconnection of the deck-forming members 14 and the stringer elements 12 of the pallets 10 of FIGS. 1 and 2.

As in the case of the pallet of FIGS. 1 and 2, three stringer elements 64 are illustrated in the pallet of FIGS. 9 and 10. Two or four or more such elements 64, however, may be used, depending on the size and strength of pallet desired.

Each of the stringer elements 64 includes a first continuous generally rectangularly-shaped elongate member 66 extending adjacent the upper deck of the pallet 10 for the length thereof.

The continuous elongate member 66 includes a horizontal element having a supporting surface 68 and downwardly depending parallel skirt elements 70 and 72 defining a channel with the horizontal element and opening downwardly. The sets of protrusions 18 extend from the supporting surface 68.

The lower edge of each skirt element 70 and 72 is bent inwardly and is integral with a channel element 74 and 76 respectively, the channels 74 and 76 opening towards the horizontal element and extending the length of the elongate member 66.

Each stringer element 64 also includes three spaced members 78 slidably connected to the elongate member 66. Each of the spaced members 78 includes a horizontal element 80 having a supporting surface from which the set or sets of protrusions 18 extend, such sets of protrusions 18 being absent in the case of the single-deck pallet of FIG. 9 and two upwardly-extending skirt elements 82 and 84 spaced apart the same distance as the skirt elements 70 and 72 and defining a channel with the horizontal element 80 opening upwardly.

The skirt elements 82 and 84 are integral with channel elements 86 and 88 respectively extending inwardly of the skirt elements 82 and 84 and extending the length of the respective spaced member 78.

The channel elements 86 and 88 are constructed to cooperate with the channel elements 74 and 76 respectively to provide an interference fit sliding relationship therebetween, whereby the individual spaced members 78 may be positioned in slidable relation to the elongate member 66.

The skirt members 82 and 84 extend into engagement with the lower edge of the skirt members 70 and 72 respectively to give an appearance of a continuous outer surface to the stringers 64 in the region of the spaced members 78.

Generally, the spaced members 78 are spaced apart equidistantly with one of the members 78 being at each end of the stringer 64 to provide fork lift truck tine-receiving openings 90. This arrangement, however, is for convenience and may be varied as desired, such as by omission of the centre one of the spaced members 78.

The opposed channels defined by the elements of the elongate member 66 and the spaced members 78 provide a generally rectangular cross-section enclosure, of similar dimension to the rectangular cross-section of the stringer elements 12.

As in the case of the embodiments of FIGS. 1 to 8, the four-way entry pallet construction of FIGS. 9 to 11 is in a knock-down form and is formed from only two types of aluminum extrusions, the members of each type being completely interchangeable one with another. The pallet may be assembled and disassembled without any special tools or skills.

The pallet construction of the present invention has a number of advantages over the prior art constructions mentioned above. Since the pallet is provided in a knock-down form and hence may be shipped and stored in compact form, initial shipping cost, storage cost and inventory cost are decreased as compared with wooden and plastic pallets. The user can make up the pallet as and when required, in the type and size required, giving considerable flexibility of choice. Unskilled labor can be used to assemble and disassemble the pallet and no special tools are required for either operation, also providing a cost advantage to the user.

Further, since aluminum is not readily corroded or damaged by exposure to the elements or extremes of temperature, moisture cannot be absorbed, and the demensions of the pallet remain the same on external exposure, the component parts of the pallet or the made up pallet may be stored exteriorally, further decreasing storage costs. This advantage also contrasts with the prior art wooden and plastic pallets. Since aluminum is inflammable and spark proof, no fire or safety hazard is attendant the use or storage of the pallets, also in contrast to the wooden and plastic pallets.

Broken or damaged pallets have considerable scrap value as aluminum metal and hence are 100% recyclable, thereby avoiding the considerable disposal problems and disposal costs of wooden and plastic pallets. Further, since the various elements are of only two types and the members of each type are wholly interchangeable, it is unlikely that the pallet would be damaged to the extent that the whole pallet would require replacing. Repair to one or more damaged parts is readily achieved by substituting a new part for the damaged part, thereby prolonging the overall effective life of the pallet. This advantage also contrasts markedly with the wooden and plastic pallets which usually have to be disposed of in their entirety.

A corrosion resistant finish may be provided to the aluminum surface, typically by anodizing when the pallet is to be used where high corrosion materials occur. Further, a highly resistant colour coating may be applied inexpensively to the aluminum, to provide color-keying for various uses, if desired. These treatments are not feasible with wooden pallets, as mentioned above.

Since the aluminum pallets of the invention do not promote fungal or bacterial growth, are very easily cleaned and sterilized, generally are non-corrodable and can be easily provided with corrosion-resistant finishes for specialist corrosion problems, are not affected by extremes of temperature, do not split or crack, or use nails, screws or other separable fasteners, are not affected by ultra-violet rays, and are light in weight, the pallets have a wide flexibility of use and may be used in many industries, including industries where wooden and plastic pallets can be used only with difficulty, or not at all.

Industries where wooden and plastic pallets can be used only with difficulty or not at all and in which the pallets of the present invention may be used include meat processing plants, dairy plants, canning factories, any food processing plant where cleanliness and health factors are essential, pharmaceutical industries, chemical industries with corrosion problems, chemical industries with explosive and fire hazards, petrochemical industries, industries where exposure to high moisture levels or liquids is frequent and warehousing or storage under refrigeration.

Further, the pallets may be used for outside storage with exposure to extreme weather conditions, in transportation industries where pallet weight is a factor, such as shipment by air cargo, in any processing or storage facility where contamination of pallets is a problem, in material handling in the Arctic region or under other extensive cold weather conditions in material handling at elevated temperatures, and in various mility and emergency uses.

SUMMARY

The aluminum pallets of the present invention, therefore, have considerable advantages over prior art wooden and plastic pallets leading to considerable versatility, cost saving and ecological advantages.

What I claim is:

1. A pallet construction comprising:

at least two spaced-apart substantially-parallel longitudinally-extending aluminum members, a first plurality of deck-forming aluminum members contacting and extending at least between the at least two longitudinally-extending members generally transverse thereto in spaced-apart relation, each of said first plurality of deck-forming members having at least one planar portion cooperating with the at least one planar portion of the others of said first plurality of deck-forming members to provide a first planar pallet deck surface which extends substantially the length of said longitudinally-extendable members, snap fit means releasably interconnecting said at least two longitudinally-extending members with each of said first plurality of deck-forming members at the intersections thereof, at each said intersection, said snap fit means includes a first part integral with said longitudinally-extending member and a second cooperating part integral with said deck-forming member, and stop means located at each said intersection and preventing movement of each of said first plurality of deck-forming members longitudinally thereof and transverse to said at least two longitudinally-extending members while normally permitting movement of said first plurality of deck-forming members out of contact with said longitudinally-extending members upon release of said snap fit means to allow disassembly of said pallet, said stop means at each said intersection including cooperating elements integral with said longitudinally-extending member and integral with said deck-forming member.

2. The pallet construction of claim 1 including a second plurality of deck forming aluminum members contacting and extending at least between the at least two longitudinally-extending members generally transverse thereto in spaced-apart relation and on the opposite side thereof from said first plurality of deck-forming aluminum members, each of said second plurality of deck-forming members being constructed identically with said first plurality of deck-forming members to provide a second planar pallet deck surface which extends substantially the length of said longitudinally-extending members parallel to said first planar pallet deck surface to provide a double-deck pallet, second snap fit means constructed identically with said first snap fit means and releasably interconnecting said at least two longitudinally-extending members with each of said second plurality of deck-forming members at the intersections thereof, and second stop means located at each said latter intersection and preventing movement of each of said second plurality of deck-forming members longitudinally thereof and transverse to said at least two longitudinally-extending members while normally permitting movement of said second plurality of deck-forming members out of contact with said longitudinally-extending members upon release of said second snap fit means to allow disassembly of said pallet, said second stop means being constructed in identical manner to said stop means at each said former intersection.

3. The pallet construction of claim 1 including three of said longitudinally-extending members constructed identically and substantially equally spaced from each other, and wherein each of said first plurality of deck-forming members is constructed identically and extends between the outer ones of said three longitudinally-extending members and terminates either flush with the outer edge of said outer ones or overhanging said outer edges, each of said spaced-apart longitudinally-extending members including a supporting surface receiving said first plurality of deck-forming members thereon.

4. The pallet construction of claim 2 including three of said longitudinally-extending members constructed identically and substantially equally spaced from each other, and wherein each of first and second plurality of deck-forming members is constructed identically and extends between the outer ones of said three longitudinally-extending members and terminates either flush with the outer edge of said outer ones or overhanging said outer edges, each of said spaced-apart longitudinally-extending members includes upper and lower spaced parallel supporting surfaces receiving said first and second plurality of deck-forming members respectively thereon, and a spacer portion integrally joining said supporting surfaces and spacing said supporting surfaces apart a distance greater than the width of said supporting surfaces, each of said longitudinally-extending members has a rectangular cross-section throughout the length thereof and said first and second supporting surfaces are provided by the shorter dimension sides of said rectangular cross section and said spacer portion is provided by the longer dimension sides of said rectangular cross-section, each of said first and second deck-forming members includes first and second coplanar portions spaced from said supporting surface at said intersections and constituting said at least one planar portion and a third planar portion engaging said supporting surface at said intersections and extending in parallel relation to said first and second coplanar portions, first and second wall portions integrally joining one side of said third planar portion to one side of one of said coplanar portions and the other side of said third planar portion to one side of the other of said coplanar portions, whereby said wall portions and said third planar portions define a first channel opening in a direction away from said longitudinally-extending members and first and second parallel skirt portions integrally joined to the other sides of said coplanar portions and extending a distance substantially equal to the height of said wall portions, whereby said skirt portion and wall portions define second and third channels with said coplanar portions opening towards said longitudinally-extending members, and said former and second snap fit means at each said intersection comprise first and second protrusions extending from said supporting surfaces and each including a shoulder projecting in opposite directions generally parallel to and spaced from said supporting surface to define an undercut therewith, said first and second protrusions constituting said first part of said snap fit means integral with said longitudinally-extending members, and first and second integral projections formed at the free edge of said skirt portions and projecting towards each other and into said undercuts at said intersections, said integral projections constituting said second part of said snap fit means integral with said deck-forming members, the extremities of said shoulders being spaced apart substantially the distance between said skirt portions.

5. The pallet construction of claim 3 wherein each of said longitudinally-extending members has a generally rectangular cross-section throughout the length thereof and said supporting surface is provided by one of the shorter dimension sides of said rectangular cross-section.

6. The pallet construction of claim 3 wherein said supporting surface is provided by a continuous wall member extending the length of said longitudinally-extending members and said longitudinally-extending members include first parallel skirt members extending downwardly from opposite sides of said continuous wall member to define a downwardly-opening channel, and a plurality of members of channel-shaped cross-section including second parallel skirt members extending upwardly from a transverse wall member and spaced apart substantially the same distance as said first parallel skirt members, said plurality of members being connected in spaced-apart relation to the lower extremities of said first parallel skirt members to provide openings for receiving fork-lift tines through said longitudinally-extending members transverse thereof and a generally rectangular cross-section to said longitudinally-extending members in the region of said plurality of members.

7. The pallet of claim 6 wherein said first parallel skirt members each has a first channel member provided adjacent the lower edge thereof and said second parallel skirt members each has a second channel member adjacent the upper edge thereof and constructed to extend in sliding interference fit with said first channel member, whereby said connection is achieved, and there are three of said spaced members for each said longitudinally-extending member, one located at each end of said longitudinally-extending member and one located approximately equidistantly spaced from said end-located members.

8. The pallet construction of claim 2 wherein each of said spaced-apart longitudinally-extending members includes upper and lower spaced parallel supporting surfaces receiving said first and second plurality of deck-forming members respectively thereon, and a spacer portion integrally joining said supporting surfaces and spacing said supporting surfaces apart a distance greater than the width of said supporting surfaces, one of said supporting surfaces is provided by a continuous wall member extending the length of said longitudinally-extending members and said longitudinally-extending members include first parallel skirt members extending downwardly from opposite sides of said continuous wall member to define a downwardly-opening channel, and a plurality of members of channel-shaped cross-section including second parallel skirt members extending upwardly from a transverse wall member constituting the other of said supporting surfaces and spaced apart substantially the same distance as said first parallel skirt members, said plurality of channel-shaped members, the first and second wall members constituting said spacer portions, and said plurality of channel-shaped members being connected in spaced-apart relation to the lower extremities of said first parallel skirt members to provide openings for receiving fork-lift tines through said longitudinally-extending members transverse thereof.

9. The pallet construction of claim 8 wherein said first parallel skirt members each has a first channel member provided adjacent the lower edge thereof and said second parallel skirt members each has a second channel member adjacent the upper edge thereof and constructed to extend in sliding interference fit with said first channel member, and there are three of said spaced members for each said longitudinally-extending member, one located at each end of said longitudinally-extending member and one located approximately equidistantly spaced from said end-located members.

10. The pallet construction of claim 5 wherein each of said plurality of deck-forming members includes first and second coplanar portions spaced from said supporting surface at said intersections and constituting said at least one planar portion and a third planar portion engaging said supporting surface at said intersections and extending in parallel relation to said first and second coplanar portions, first and second wall portions integrally joining one side of said third planar portion to one side of one of said coplanar portions and the other side of said third planar portion to one side of the other of said coplanar portions, whereby said wall portions and said third planar portions define a first channel opening in a direction away from said longitudinally-extending members, and first and second parallel skirt portions integrally joined to the other sides of said coplanar portions and extending a distance substantially equal to the height of said wall portions, whereby said skirt portion and wall portions define second and third channels with said coplanar portions opening towards said longitudinally-extending members, and said snap fit means at each said intersection comprise first and second protrusions extending from said supporting surface and each including a shoulder projecting in opposite directions generally parallel to and spaced from said supporting surface to define an undercut therewith, said first and second protrusions constituting said first part of said snap fit means integral with said longitudinally-extending members and first and second integral projections formed at the free edge of said skirt portions and projecting towards each other and into said undercuts at said intersections, said integral projections constituting said second part of said snap fit means integral with said deck-forming member, the extremities of said shoulders being spaced apart substantially the distance between said skirt portions.

11. The pallet construction of claim 10 wherein one of said projections extends a greater distance towards said third planar portion than the other.

12. The pallet construction of claim 11 wherein, in profile, each of said shoulders has a generally straight edge at the side thereof adjacent to said planar portion and a curved edge at the opposite side thereof tapering to the outer extremity thereof and the other of said projections has a curved surface positioned to engage said curved edge of the adjacent shoulder during assembly of said pallet.

13. The pallet construction of claim 10 wherein said stop means at each said intersection comprises a third protrusion extending from said supporting surface and located between said first and second protrusions, said third protrusion constituting one of said cooperating elements of said stop means and an opening formed through said third planar portion receiving said third protrusion therethrough, said opening constituting the other cooperating element of said stop means.

14. The pallet construction of claim 13 wherein said third protrusion is thin and extends generally longitudinally of said supporting surface and said opening is in the form of a slit extending generally transverse of said third planar portion and dimensioned to receive said protrusion therethrough with minimum clearance.

15. The pallet construction of claim 14 wherein said first, second, and third protrusions are in straight line alignment with each other and with the other first, second, and third protrusions projecting from said supporting surface.

16. The pallet construction of claim 4 wherein one of said projections extends a greater distance towards said third planar portion than the other, and in profile, each of said shoulders has a generally straight edge at the side thereof adjacent to said planar portion and a curved edge at the opposite side thereof tapering to the outer extremity thereof and the other of said projections has a curved surface positioned to engage said curved edge of the adjacent shoulder during assembly of said pallet.

17. The pallet construction of claim 4 wherein said former and second stop means at each said intersection comprises a third protrusion extending from said supporting surfaces and located between said first and second protrusions, said third protrusion constituting one of said cooperating elements of said stop means, and an opening formed through said third planar portion receiving said third protrusion therethrough, said opening constituting the other cooperating element of said stop means, said third protrusion being thin and extending generally longitudinally of said supporting surface, said opening being in the form of a slit extending generally transverse of said third planar portion and dimensioned to receive said protrusion therethrough with minimum clearance.

18. The pallet construction of claim 17 wherein said first, second and third protrusions are in straight line alignment with each other and with the other first, second and third protrusions projecting from the respective supporting surface.

19. The pallet construction of claim 8 wherein each of said first and second deck-forming members includes first and second coplanar portions spaced from said supporting surface at said intersections and constituting said at least one planar portion and a third planar portion engaging said supporting surface at said intersections and extending in parallel relation to said first and second coplanar portions, first and second wall portions integrally joining one side of said third planar portion to one side of one of said coplanar portions and the other side of said third planar portion to one side of the other of said coplanar portions, whereby said wall portions and said third planar portions define a first channel opening in a direction away from said longitudinally-extending members and first and second parallel skirt portions integrally joined to the other sides of said coplanar portions and extending a distance substantially equal to the height of said wall portions, whereby said skirt portion and wall portions define second and third channels with said coplanar portions opening towards said longitudinally-extending members, and said former and second snap fit means at each said intersection comprise first and second protrusions extending from said supporting surfaces and each including a shoulder projecting in opposite directions generally parallel to and spaced from said supporting surface to define an undercut therewith, said first and second protrusions constituting said first part of said snap fit means integral with said longitudinally-extending members, the extremities of said shoulders being spaced apart substantially the distance between said skirt portions.

20. The pallet construction of claim 19 wherein one of said projections extends a greater distance towards said third planar portion than the other, and in profile, each of said shoulders has a generally straight edge at the side thereof adjacent to said planar portion and a curved edge at the opposite side thereof tapering to the outer extremity thereof and the other of said projections has a curved surface positioned to engage said curved edge of the adjacent shoulder during assembly of said pallet.

21. The pallet construction of claim 19 wherein said former and second stop means at each said intersection comprises a third protrusion extending from said supporting surfaces and located between said first and second protrusions, said third protrusion constituting one of said cooperating elements of said stop means, and an opening formed through said third planar portion receiving said third protrusion therethrough, said opening constituting the other cooperating element of said stop means, said third protrusion being thin and extending generally longitudinally of said supporting surface, said opening being in the form of a slit extending generally transverse of said third planar portion and dimensioned to receive said protrusion therethrough with minimum clearance.

22. The pallet construction of claim 21 wherein said first second, and third protrusions are in straight line alignment with each other and with the other first, second, and third protrusions projecting from the respective supporting surface.

23. In combination, a first substantially rigid elongate member having a flat surface, a second elongate member having a flat central portion thereof in engagement with said flat surface, first and second projections upstanding from said flat surface of said first member, each of said projections having a shoulder projecting therefrom in opposite directions to each other generally parallel to said flat surface and defining an undercut with said flat surface, first and second shoulder engaging members integrally joined to said central flat portion of said second elongate member and projecting towards said central flat portion, said shoulder-engaging members being positioned one in each of said undercuts in engagement with the respective shoulder, said second elongate member being capable of limited flexure about its centre line for release of at least one of said shoulder-engaging members from its respective undercut to allow separation of the second elongate member from the first elongate member, a third projection upstanding from said flat surface of said first elongate member, and an opening in said central portion of said second elongate member receiving said third projection therethrough preventing movement of said second elongate member transverse of said first elongate member and normally permitting said separation of the second elongate members from the first elongate member upon said limited flexure.

24. The combination of claim 23 wherein said first, second and third projections are thin and extend in straight line alignment and said opening is in the form of a slot.

25. The combination of claim 23 wherein said central flat portion and said first and second shoulder engaging members of said second elongate member are integrally joined by coplanar portions spaced from and parallel to the central flat portion and arranged one each side of said central flat portion, first and second upstanding portions extending between said coplanar portions and each side of said central portion to define with the central portion a channel and first and second skirt portions depending one from each of said coplanar portions at the side thereof opposite to said wall portions and terminating in said shoulder-engaging members.

26. The combination of claim 25 wherein one of said shoulder-engaging members extends towards said central flat portion a distance greater than the other of said shoulder-engaging members.

* * * * *